US006402572B1

(12) United States Patent
Sevier et al.

(10) Patent No.: US 6,402,572 B1
(45) Date of Patent: Jun. 11, 2002

(54) ELECTRIC SWITCHING DEVICE ASSEMBLY SYSTEM

(75) Inventors: Richard W. Sevier, Goleta; James J. Keenan, Santa Barbara, both of CA (US)

(73) Assignee: Hendry Mechanical Works, Goleta, CA (US)

( * ) Notice: Subject to any disclaimer, the term of this patent is extended or adjusted under 35 U.S.C. 154(b) by 0 days.

(21) Appl. No.: 08/978,033

(22) Filed: Nov. 25, 1997

(51) Int. Cl.[7] ..... H01R 13/432
(52) U.S. Cl. ..... 439/748; 29/842; 361/636
(58) Field of Search ..... 439/748, 180, 439/200, 248; 29/842, 844, 845, 592.1, 622, 854, 857; 361/634, 644, 647, 648, 649, 650, 636, 635, 629, 652, 653, 656

(56) References Cited

U.S. PATENT DOCUMENTS

| | | | | | |
|---|---|---|---|---|---|
| 3,059,216 | A | | 10/1962 | Cunningham | 339/217 |
| 3,078,439 | A | | 2/1963 | McKee et al. | 339/217 |
| 3,273,109 | A | * | 9/1966 | Moulin | 439/109 |
| 3,311,866 | A | | 3/1967 | Williamson | 339/217 |
| 3,697,927 | A | * | 10/1972 | Kunkle et al. | 439/748 |
| 3,938,438 | A | | 2/1976 | Anderson et al. | 102/7.2 |
| 3,944,255 | A | | 3/1976 | Martinson | 208/289 |
| 3,957,337 | A | | 5/1976 | Damiano | 339/217 |
| 4,292,021 | A | | 9/1981 | Miyagawa | 431/13 |
| 4,333,703 | A | | 6/1982 | Anhalt et al. | 339/217 |
| 4,591,222 | A | | 5/1986 | Shaffer | 339/74 R |
| 4,637,551 | A | | 1/1987 | Seeger, Jr. et al. | 239/288.5 |
| 4,655,526 | A | | 4/1987 | Shaffer | 339/74 R |
| 4,701,004 | A | | 10/1987 | Yohn | 439/871 |
| 4,707,050 | A | | 11/1987 | Konnemann | 439/747 |
| 4,796,355 | A | * | 1/1989 | Burch et al. | 29/622 |
| 4,850,356 | A | | 7/1989 | Heath | 128/419 D |
| 5,097,589 | A | * | 3/1992 | Rezac et al. | 29/622 |
| 5,131,873 | A | | 7/1992 | Gierut et al. | 439/851 |

(List continued on next page.)

OTHER PUBLICATIONS

US Patent and Trademark Office Patent Full Text and Image Database; Searching 1976–2000 and listing "safe distance" in claims of 111 patents, Sep. 23, 2000, Exhibit X.

Leaflet entitled "High Current Pin and Socket Contacts", AMP Incorporated, dated Oct. 17, 1996.

*Primary Examiner*—P. Austin Bradley
*Assistant Examiner*—Ross Gushi
(74) *Attorney, Agent, or Firm*—Koppel, Jacobs, Patrick & Heybl

(57) ABSTRACT

An electric switching device is assembled with an electric terminal and a power panel having a first side at the electric switching device and second side at the electric terminal. The electric switching device has a prong, and a receptacle is made for that prong. That receptacle is provided with an external catch for a detent. The power panel is provided with an aperture having a detent for the catch. A flexible electric conductor is connected to that receptacle at a safe distance from the power panel and any power busses and that flexible electric conductor is connected to the electric terminal. The receptacle is inserted into the aperture from the second side of the power panel until the catch catches the detent. The electric switching device is assembled with the power panel by insertion of the prong into the receptacle. Assemblies of an electric switching device, an electric terminal and a power panel include a prong projecting from the switching device, a receptacle of that prong in an aperture of the power panel, a releasable catch on that receptacle and a corresponding detent in the aperture, and a flexible electric conductor between that receptacle and the electric terminal. The receptacle preferably is equipped with a heat sink. Such heat sink may be provided as an extension of that receptacle to which the flexible electric conductor may be connected and/or may be provided in the power panel.

27 Claims, 5 Drawing Sheets

U.S. PATENT DOCUMENTS

| | | | | | |
|---|---|---|---|---|---|
| 5,147,227 | A | | 9/1992 | Yurko | 439/773 |
| 5,176,529 | A | | 1/1993 | Heinz et al. | 439/181 |
| 5,195,982 | A | | 3/1993 | Hoenig | 604/192 |
| D337,990 | S | | 8/1993 | Wright | D13/133 |
| 5,242,351 | A | | 9/1993 | Berg et al. | 482/110 |
| 5,269,055 | A | * | 12/1993 | Dessi | 29/622 |
| 5,366,391 | A | | 11/1994 | Deiss | 439/740 |
| 5,415,067 | A | | 5/1995 | Nielson | 83/13 |
| 5,556,292 | A | | 9/1996 | Kato et al. | 439/218 |
| 5,588,852 | A | | 12/1996 | Puerner | 439/135 |
| 5,726,852 | A | * | 3/1998 | Trifiletti et al. | 361/115 |
| 5,797,954 | A | | 8/1998 | Shaffer et al. | 606/201 |
| 5,807,120 | A | * | 9/1998 | Matthews | 439/748 |
| 5,918,361 | A | * | 7/1999 | Maolem et al. | 29/622 |
| 6,002,580 | A | * | 12/1999 | Le Vantine et al. | 361/634 |
| 6,012,531 | A | | 1/2000 | Ryan | 169/36 |

* cited by examiner

ELECTRIC SWITCHING DEVICE ASSEMBLY SYSTEM

FIELD OF THE INVENTION

The subject invention relates to electric switching device assembly systems, including methods of assembling electric switching devices with panels and electric terminals, and assemblies including electric switching devices with panels and electric terminals.

BACKGROUND

Some forty years ago, James D. Cunningham designed an electrical connector at Consolidated Electrodynamics Corporation. As apparent from his U.S. Pat. No. 3,059,216, issued Oct. 16, 1962, that electrical male or female connector had a snap-in connector assembly comprising a spring retainer having a plurality of projecting fingers engaging an internal shoulder of an insulating block.

Variations of that principle are apparent from, or in some form may be seen in sundry connectors, terminals and assemblies, such as seen in U.S. Pat. Nos. 3,078,439, by McKee et al, issued Feb. 19, 1963, 3,311,866, by Robert L. Williamson, issued Mar. 28, 1967, 3,957,337, by Ralph R. Damiano, issued May 18, 1976, 4,333,703, by Anhalt et al, issued Jun. 8, 1982, 4,591,222, by Howard R. Shaffer, issued May 27, 1986, 4,655,526, by Howard R. Shaffer, issued Apr. 7, 1987, 4,701,004, by Brent D. Yohn, issued Oct. 20, 1987, 4,707,050, by Alfred Konnemann, issued Nov. 17, 1987, 5,131,873, by Gierut et al, issued Jul. 21, 1992, 5,147,227 by Garold M. Yurko, issued Sep. 15, 1992, 5,366,391, by Werner Deiss, issued Nov. 22, 1994, 5,556,292, by Kato et al, issued Sep. 17, 1996, 5,588,852, by Dean A. Puerner, issued Dec. 31, 1996, and Des. 337,990, by John O. Wright, issued Aug. 3, 1993.

Yet despite a wealth of prior art, terminal panels for plug-in type of high-current electric switching devices, such as circuit breakers, have continued to necessitate manual assembly of electrical conductors at terminal panels, using heavy wires and terminal implements such as ring lugs for screw terminals. In such installations, movement of heavy wires can loosen screw terminals, which degrades electric conductance through such terminals, generates excessive heat from electric currents flowing therethrough, and exposes the installation to danger of malfunction and even fire. Wrenches and screw drivers needed in hand wiring at such terminal panels with prior-art plug-in receptacles during manual assembly can short out power busses, and screws and lock washers can fall and can also short out power busses at terminal panels, thereby causing further malfunction and even bodily injury. Concurrently, existing snap-in connector technology has not been adequate for heavy-current applications where heat generation has to be kept at a minimum.

SUMMARY OF THE INVENTION

It is a general object of the invention to provide improved methods of assembling electric circuit breakers herein sometimes referred to as, switching devices with power panels and electric terminals.

It is a related object of the invention to provide improved assemblies including electric switching devices with power panels and electric terminals.

Other objects become apparent in the further course of this disclosure.

The subject invention resides in a method of assembling an electric circuit breaker with an electric terminal and a power panel having a first side at said electric circuit breaker and second side at said electric terminal, and, more specifically, resides in the improvement comprising, in combination, equipping that electric circuit breaker with a prong, making a receptacle for that prong, equipping that receptacle with an external catch for a detent, and equipping the power panel with an aperture having a detent for the catch, connecting a flexible electric conductor to that receptacle at a safe distance from the power panel and connecting the flexible electric conductor to the electric terminal, and inserting the receptacle into the aperture from the second side of the power panel until the catch catches the detent.

The electric circuit breaker is assembled with the power panel by insertion of the prong into the receptacle.

From a related aspect thereof, the subject invention resides in a method of assembling an electric circuit breaker with first and second electric terminals and a power panel having a first side at the electric circuit breaker and second side at the second electric terminal, and, more specifically, resides in the improvement comprising in combination, equipping the electric circuit breaker with spaced first and second prongs, making a first receptacle for the first prong in the first electric terminal, making a second receptacle for the second prong, equipping that second receptacle with an external catch for a detent, equipping the power panel with an aperture having a detent for that catch, connecting a flexible electric conductor to that second receptacle at a safe distance from the power panal and first electric terminal and connecting the flexible electric conductor to the second electric terminal, and inserting that second receptacle into the aperture from the second side of the power panel until the catch catches the detent.

The electric circuit breaker is assembled with the power panel by insertion of the first and second prongs into the first and second receptacles.

The sequence of features given in this summary and in the corresponding method claims represent the currently conceived best mode, but the broad scope of the invention is not necessarily limited to such sequence unless otherwise indicated hereinafter.

The subject invention also resides in an assembly including an electric switching device, an electric terminal and a power panel having a first side at that electric switching device and an opposite second side at the electric terminal, and, more specifically, resides in the improvement comprising, in combination, a prong projecting from the switching device, a receptacle of that prong in an aperture of the power panel, a releasable catch on that receptacle and a corresponding detent in the aperture, and a flexible electric conductor between that receptacle and the electric terminal.

From a related aspect thereof, the subject invention resides in an assembly including an electric switching device, first and second electric terminals and a power panel having a first side at the electric switching device and an opposite second side at the second electric terminal, and, more specifically, resides in the improvement comprising, in combination, spaced first and second prongs projecting from that switching device, a first receptacle of the first prong in the first electric terminal, a second receptacle of the second prong in an aperture of the power panel, a releasable catch on the second receptacle and a corresponding detent in the aperture, and a flexible electric conductor between the second receptacle and the second electric terminal.

Such assemblies may be made by the methods herein disclosed of the invention and its embodiments.

BRIEF DESCRIPTION OF THE DRAWINGS

The subject invention and its various aspects and objects will become more readily apparent from the following detailed description of preferred embodiments thereof, illustrated by way of example in the accompanying drawings which also constitute a written description of the invention, wherein like reference numerals designate like or equivalent parts, and in which.

DESCRIPTION OF PREFERRED EMBODIMENTS

Figure 1:
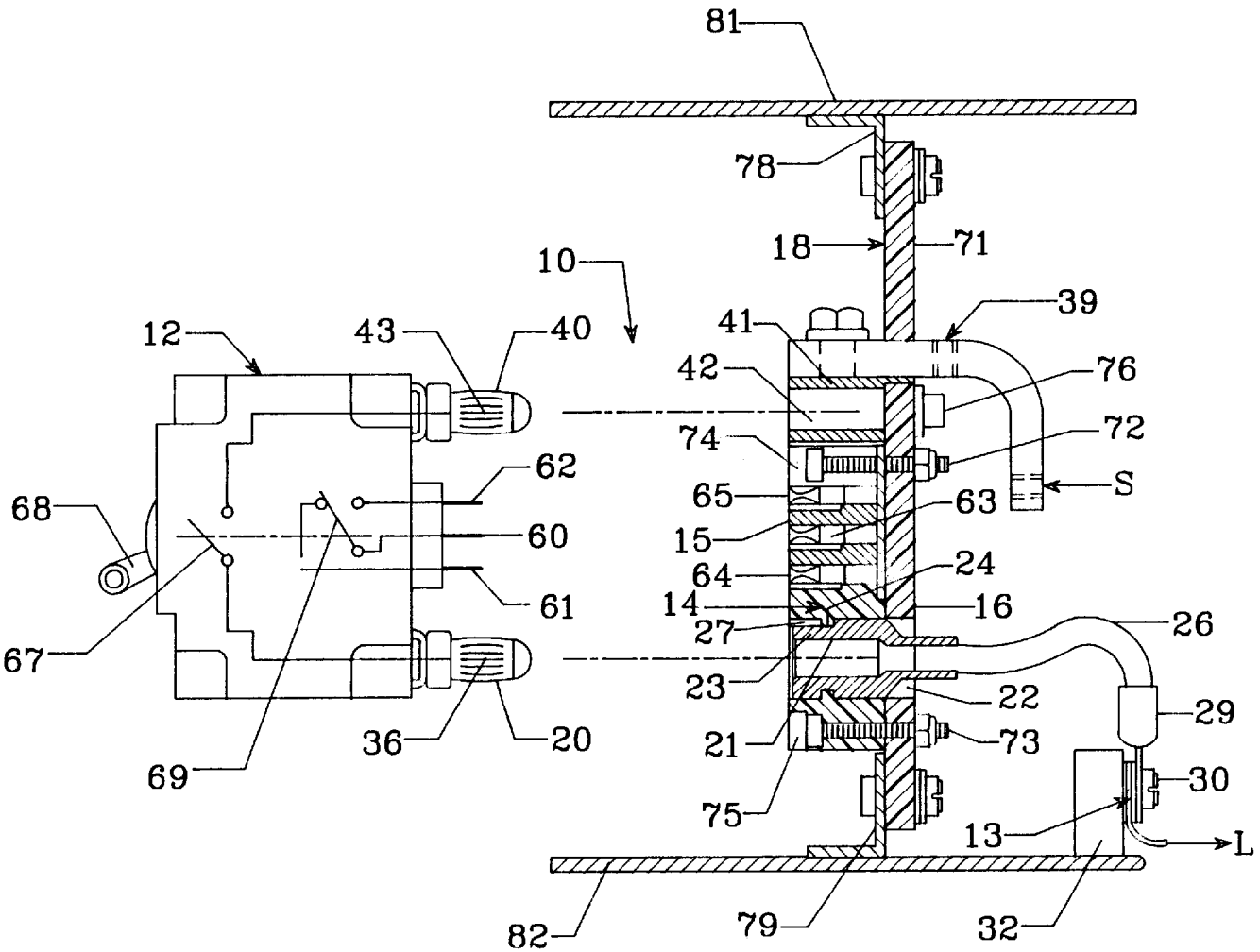
FIG. 1 is a side view, partially in section and partially exploded, of an electric switching device assembly according to an embodiment of the invention.

The embodiment of the invention as shown in FIG. 1 resides in an assembly 10 including an electric switching device 12 which is an electric circuit breaker, an electric terminal 13 and a power panel 14 having a first side 15 at the electric switching device and an opposite second side 16 at the electric terminal. In this respect, the phrases "at the electric switching device" and "at the electric terminal", and phrases of similar import, are not intended to be limited to signify possible proximity, but are intended to be broad enough to signify orientation. For example, the phrase "at the electric switching device" may signify such meanings as "immediately adjacent the electric switching device 12," or "facing in the direction of the electric switching device." Similarly, the phrase "at the electric terminal," may cover such meanings as "adjacent the terminal 13" (as distinguished from the opposite side 15), or "facing in the direction of the terminal 13," or "oriented in the direction of the terminal 13," to mention some examples.

Also, what is referred to herein as "power panel" may be an insulating block or other part of a power panel assembly 18.

The example as seen in FIG. 1 embodies the improvement comprising, in combination, a prong 20 projecting from the switching device 12, a receptacle 21 of that prong in an aperture 22 of power panel 14, a releasable catch 23 on that receptacle 21 and a corresponding detent 24 in that aperture, and a flexible electric conductor 26 between that receptacle 21 and the electric terminal 13.

Figure 3:
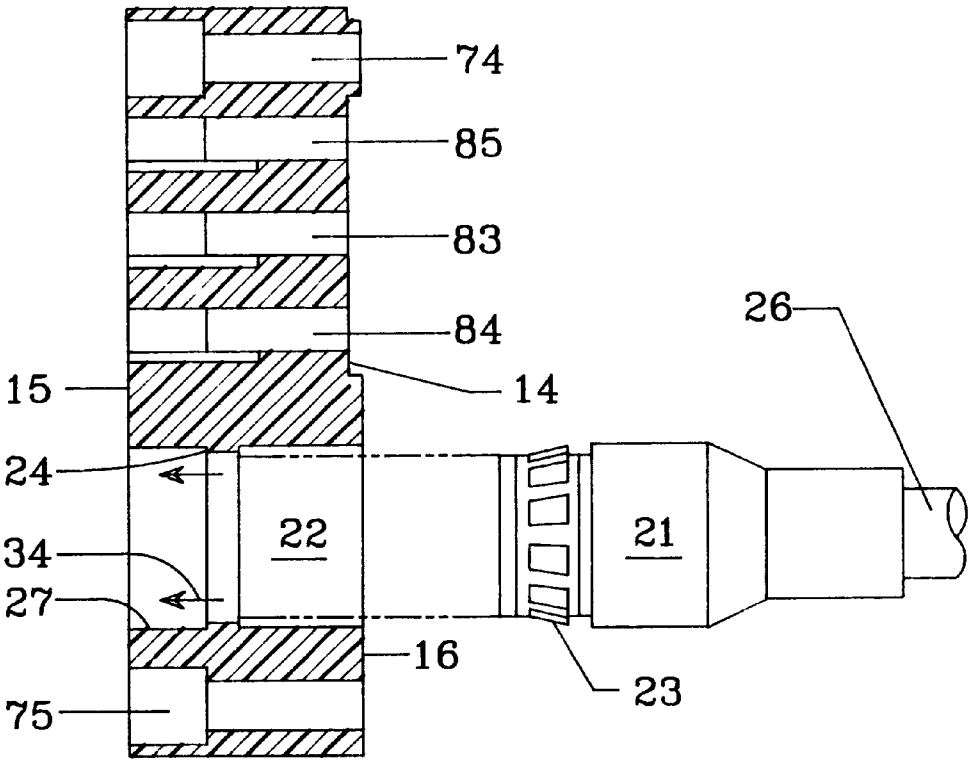
FIG. 3 is a section taken on the line 3—3 in FIG. 2 together with a receptacle for insertion into an aperture of the power panel shown in FIGS. 1 and 2.
Figure 2:
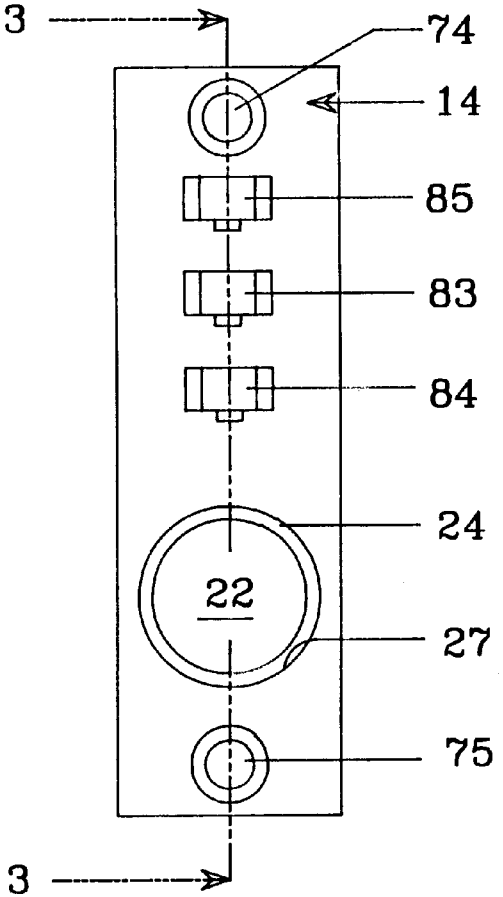
FIG. 2 is an enlarged front elevation of an insulating block or power panel used in the assembly of FIG. 1.
Figure 4:
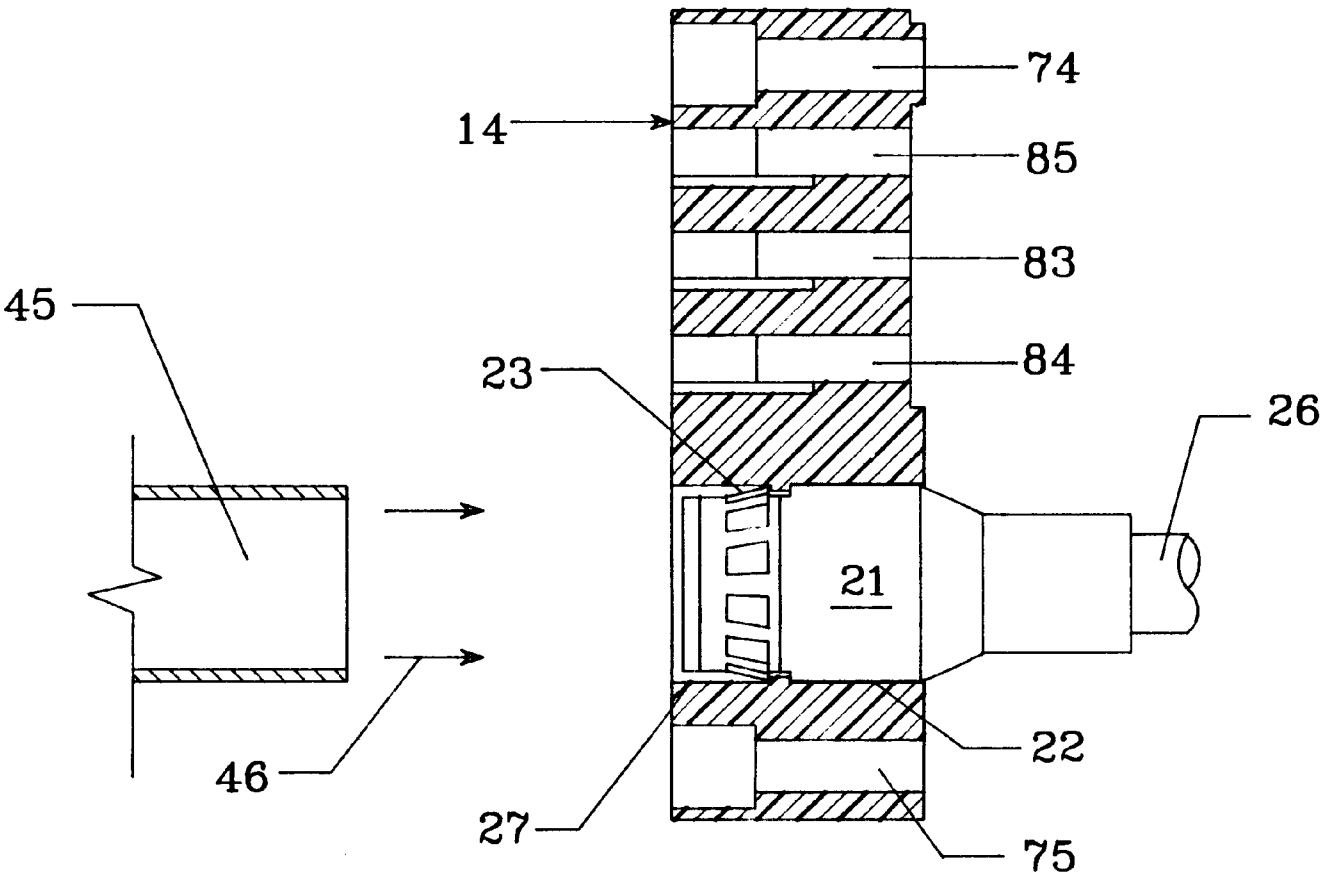
FIG. 4 is a detail view comprising a broken off portion of FIG. 3, the inserted receptacle, and a tool for removing that receptacle from the power panel.

As seen in FIGS. 1 to 4, the aperture 22 may have a front opening 27 at the first side 15 of the power panel 14. The catch 23 is at the detent 24 in that front opening 27, such as seen in FIGS. 1 and 4 when the receptacle 21 is fully inserted into the power panel 14. Detent 24 preferably includes a stepped structure of the aperture 22, such as seen in FIGS. 1 to 4 and 6 to 8 at 24.

The drawings also show a method of assembling an electric switching device 12 with an electric terminal 13 and a power panel 14 having the above mentioned first side 15 at the electric switching device and second side 16 at that electric terminal.

The method according to the invention equips the electric switching device 12 with the prong 20 and makes a receptacle 21 for that prong. That method also equips such receptacle with an external catch 22 for the detent 24. The manufacturer of the power panel 14 equips such power panel with the aperture 22 having the detent 24 for the catch 23 of the receptacle 21, and with the front opening 27, if desired.

According to the invention, a flexible electric conductor 26 is connected to that receptacle, such as by soldering, crimping and the like. This typically is done by the manufacturer or at the factory where the receptacle 21 is made or is readied for shipment and subsequent assembly into the power panel 14, and at the latest is done before the receptacle 21 is inserted into the aperture 22. In all these cases, the step of connecting a flexible electric conductor to that receptacle is performed at a safe distance from the power panel 14. This requirement of the subject invention covers a range from (a) connection of the flexible electric conductor to that receptacle at the manufacturer, to (b) a connection of that flexible electric conductor to that receptacle at the site of the power panel, but at a safe enough distance therefrom so that there is no danger of shorting out source busses 39 and other power busses of the type typically present at power panels.

In either case, the flexible electric conductor 26 is connected to the electric terminal 13. Within the scope of the invention set forth in the appendant claims, this may be done (c) before or after the receptacle 21 is inserted into the aperture 22, as long as (d) the flexible electric conductor 26 is connected to the receptacle 21 at the safe enough distance such as mentioned at (b) in the preceding paragraph, (e) before the receptacle 21 bearing the previously attached conductor 26 is inserted into the aperture 22.

The subject invention thus avoids the above mentioned dangers of prior-art approaches, including a shorting of power busses and a degradation of conductance and an overheating of terminals caused or eventuated by manual connections, at the power panel, of electrical conductors of the type shown at 26 to stationary plug-in terminals for circuit breakers in prior-art installations. In particular, since electric conductor 26 has been soldered, crimped or otherwise connected to the receptacle 21 at the above mentioned safe distance, there need to be no hand wiring of the type heretofore traditional for electric circuit breaker and similar installations at the installed power panel 14 itself for a connection of the receptacle 21 to the terminal 13. Rather, the electric conductor can simply be attached to the terminal 13, instead of having to be handwired to a receptacle already in the power panel.

In practice, the manufacturer of the receptacle 21 and conductor 26 assembly may provide such conductor with a terminal eyelet 29 or similar device at the free end thereof, for easy attachment and connection to the terminal 13, such as via a screw, nut or other fastener 30.

The terminal 13 typically is connected to a load L by a load conductor 31. The terminal 13 may be located on an insulating block 32 that may be part of or separate from the power panel assembly 18.

The final assembler inserts the receptacle 21 into the aperture 22 from the second side 16 of the power panel 14, such as shown in FIG. 3 with the aid of dotted arrows 34, until the catch 23 catches the detent 24, such as by passing under and through the stepped structure or aperture constriction at 24. The catch or catches 23 are inwardly flexible for that purpose, and flex outwardly to catch the catch 24 and to be caught thereby, such as seen in FIGS. 1 and 4. The flexible electric conductor 26 typically is then already attached to the terminal 13, such as described above, or may be attached thereto at that point, within the scope of the invention.

This completes the assembly of power panel 14, receptacle 21, electric conductor 26 and terminal 13. The electric switching device 12 may then be assembled with such power panel 15 or power panel assembly 18 by insertion of its prong 20 into the installed receptacle 21.

The prong 20 may be of a split or banana plug type or may otherwise have or be equipped with resilient contact surfaces 36 that will engage an axial bore or inside of the receptacle 21. The prong may have a louvered resilient contact structure at 36 that will engage an inside of the receptacle 21 for optimum electric contact.

According to a preferred embodiment of the invention, the assembly includes first and second electric terminals. The first of these terminals is the terminal or terminal assembly 39, and the second one of these first and second terminals now is the above mentioned terminal 13. If that terminal 13 is a load terminal L, then the terminal 39 may be a source terminal S. For instance, the terminal 39 may be connected to an electric power maine bus or other source S of electric power. However, the scope of the invention is not so limited, as the terminal 39 may be another terminal similar to terminal 13.

The electric switching device 12 preferably is equipped with spaced first and second prongs 40 and 20, and a first receptacle 41 is made for that first prong 40 in the first electric terminal or terminal assembly 39. Within the scope of the invention, the first receptacle 41 may be a duplicate of or may be similar to what is now considered the second receptacle 21. However, if the terminal 39 is a source terminal S, then the first receptacle 41 may, for example, be constituted by a power supply or source bus having one or more receptacle apertures 42 for receiving one or more first prongs 40 of one or more electric switching devices 12.

The receptacle 21 may now be a second receptacle; that is, a receptacle for what is now the second prong 20, and such second receptacle may be equipped with an external catch 23 for a detent 24. The power panel 14 is equipped with the previously described aperture 22 having the detent 24 for the receptacle catch 23.

A flexible electric conductor 26 may be connected to such second receptacle 21 at a safe distance from the power panel and electric terminal 41 and power bus 39, such as in the manner described above, and the flexible electric conductor 26 is connected to the second electric terminal 13, either before or after connection of that flexible electric conductor 26 to the second receptacle 21 such as described above.

The second receptacle 21 with previously connected flexible electric conductor 26 is moved as a unit to the power panel and such second receptacle is inserted into the aperture 22 from the second side 16 of the power panel 14 until the catch 23 catches the detent 24 or is caught thereby.

The electric switching device is assembled with the power panel 14 by insertion of the first and second prongs 40 and 20 into the first and second receptacles 41 and 21, respectively.

Both first and second prongs 40 and 20 preferably are equipped with resilient contact surfaces 43 and 36 for engaging insides of the first and second receptacles 41 and 21, respectively. By way of example, the first and second prongs 40 and 20 are equipped with first and second louvered resilient contact structures at 43 and 36 for engaging insides of the first and second receptacles 41 and 42, respectively.

In apparatus terms, an assembly 10 according to a preferred embodiment of the invention includes an electric switching device 12, first and second electric terminals 39 and 13 and a power panel 14 having a first side 15 at the electric switching device 12 and an opposite second side 16 at the second electric terminal 13.

Spaced first and second prongs 40 and 20 project from the switching device 12. A first receptacle 41 of the first prong 40 is in the first electric terminal 39. A second receptacle 21 of the second prong 20 is in an aperture 22 of power panel 14. The releasable catch 23 is on the second receptacle 21 and a corresponding detent 24 is in the aperture 22. The flexible electric conductor 26 is between second receptacle 21 and the second electric terminal 13.

Such assembly may be provided with features of the above mentioned type.

The first and second prongs 40 and 20 are removed from their first and second receptacles 41 and 21 by removal of the electric switching device 12 from the power panel 14.

As a special feature of the invention, the receptacle 21 may be easily removed from power panel 14, such as for service or replacement. In this manner, the part most likely to be worn may easily be replaced by a like receptacle (21) with factory-attached conductor 26 having preferably a terminal eyelet or similar terminal attachment device 29 thereat. Alternatively, the assembly may easily be adapted to various switching power ratings without the traditional type of hand wiring being necessary. For instance, a receptacle 21 and integral conductor 26 combination designed for amperage within a first range, such as a 30 ampere range, may easily be replaced by a similar receptacle and conductor combination that was designed for a higher amperage within a second range, such as a 50 ampere range, or by a similar receptacle and conductor combination that was designed for a lower amperage within a third range, such as a 20 ampere range, to name but a few examples.

In this respect, the catch 23 is mechanically released from detent 24 and the receptacle 21 thereupon may be removed from aperture 22 or power panel 14. This facility may be aided by provision of the aperture 22 with the front opening 27 at the first side 15 of the power panel 14 for accommodating the catch 23 at detent 24 upon complete insertion of the second receptacle 21 into the aperture 22 from the second side 16 of the power panel 14, and for permitting access to catch 23 for removal of the receptacle 21.

By way of example, a receptacle removal tool 45 may be employed for that purpose. After the first and second prongs 40 and 20 have been removed from their first and second receptacles 41 and 21 by removal of the electric switching device 12 from power panel 14, the catch 23 may be mechanically released from the detent 24 with the tool 45 operating through the front opening 27, and the thus released second receptacle 21 may thereupon be removed from the aperture 22 or power panel 14.

Tool 45 is made insertable into front opening 27 for mechanically releasing catch 23 from detent 24 and, for this purpose, may comprise a thin-walled tube whose outside diameter fits into the enlarged front opening 27, and whose inside diameter or clearance is designed to press down the projecting catches 23 when inserted onto the front end of the receptacle 21, as indicated in FIG. 4 by dotted arrows 46.

The existence of such tools greatly facilitates the replacement feature of receptacle 21.

The electric switching device 12 may have auxiliary prongs 60, 61 and 62 for control signal currents, and power panel 14 may be equipped with corresponding auxiliary receptacles 63, 64 and 65 for such auxiliary prongs. These auxiliary prongs 60, 61 and 62 may be located between the first and second main prongs 40 and 20, and the auxiliary receptacles 63, 64 and 65 correspondingly may be located between the first and second main receptacles 41 and 21.

By way of example, FIG. 1 diagrammatically shows the switching device 12 with a main switch 67 that is actuated by a toggle 68 and operates between the main prongs 20 and 40. FIG. 1 also diagrammatically shows an auxiliary switch 69 that is ganged to the main switch 67 and that alternatively connects the auxiliary prong 60 to the auxiliary prongs 61 and 62 so as to indicate the open and closed positions of the switching device 12, respectively. The corresponding auxiliary receptacles 63 to 65 may be connected to a conventional sensing circuit (not shown) signaling the open and closed positions of the main switch 67.

As another example, the switching device 12 may have an internal solenoid or other electromagnetic actuator (not shown) that actuates and deactivates the main switch 67 in response to application of control currents through auxiliary prongs and receptacles 60 to 65. Conventional circuitry may be employed for that purpose.

The insulating block or power panel 14 may be mounted on a support plate 71 by fasteners 72 and 73 extending through holes 74 and 75. The first receptacle or power supply bus 41 may be attached to mounting plate 71 by bolts 76 adjacent power panel 14. Lug and bolt combinations 78 and 79 may mount the support plate 71 inside cabinet walls 81 and 82.

The power panel 14 may be provided with apertures 83, 84 and 85 for accommodating auxiliary receptacles 63, 64 and 65, respectively.

The currently most favored application of the illustrated embodiment of the invention is the mounting and operation of electric circuit breakers 12 that trip in response to overloads. In such applications, electric current through receptacle 21 and conductor 26 may be very high before the circuit breaker trips. The subject invention combines high reliability with easy exchangeability as hereinabove disclosed.

Figure 5:
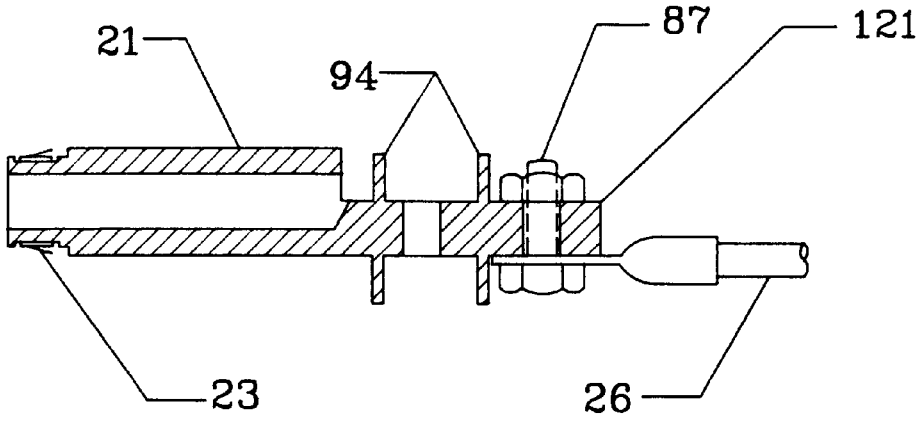
FIG. 5 is a section through a further receptacle according to an embodiment of the invention.

In this respect, a preferred embodiment of the invention equips the receptacle with a heat sink. Such heat sink may be provided as an extension 121 of that receptacle 21, such as shown in FIG. 5. The flexible electric conductor preferably is connected to that extension, such as by fasteners 87. The flexible electric conductor 26 thus is between the extension 121 and electric terminal 13.

Figure 6:
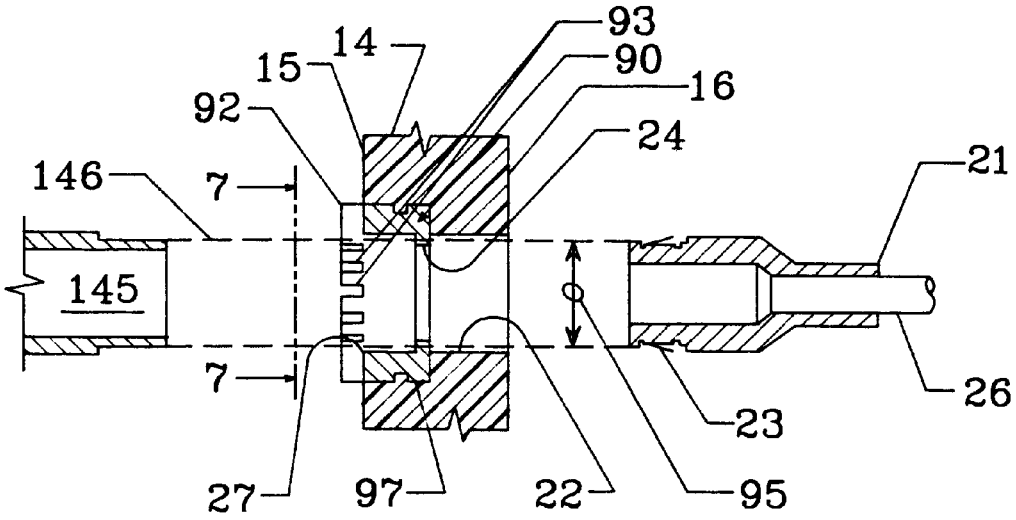
FIG. 6 is an exploded view of an assembly and disassembly according to a further embodiment of the invention.
Figure 7:
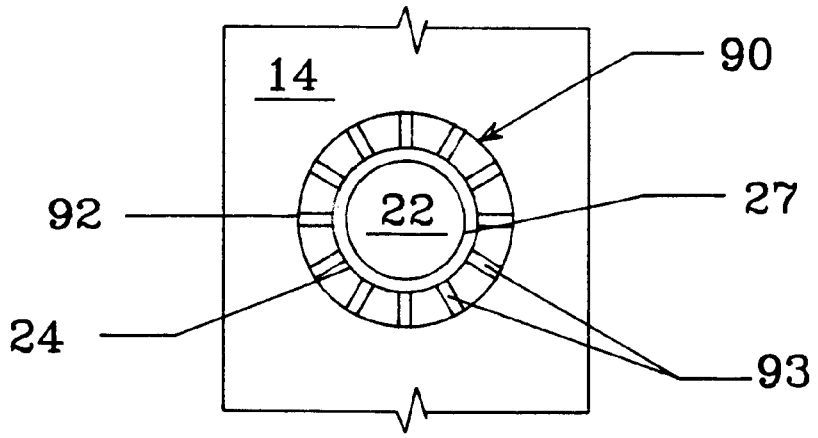
FIG. 7 is a frontal view taken in the direction 7—7 of the assembly of FIG. 6.
Figure 8:
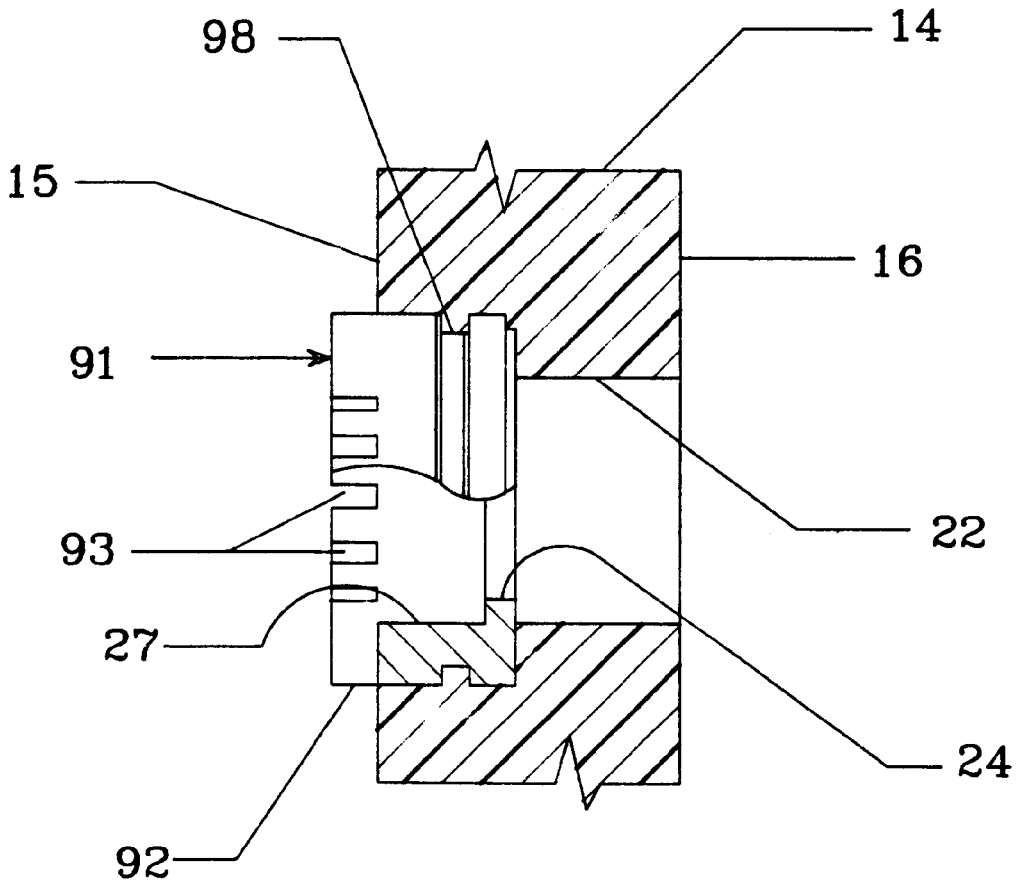
FIG. 8 is a section through a power panel with heat sink insert according to a further embodiment of the invention.

Alternatively or additionally, the heat sink may be provided in the power panel 14, such as shown in FIGS. 6 to 8. Such heat sink 90 or 91 may be provided with a heat radiator 92 at the power panel. As shown in FIGS. 6 to 8, such radiator may have heat-radiating radiating radial fins 93. Similar fins 94 may be provided in the extension 121 for radiating heat away from the receptacle 21.

According to the embodiment shown in FIGS. 6 to 8, the heat sink 90 or 91 surrounds the receptacle in the power panel, when that receptacle 21 is inserted into that heat sink in the power panel as indicated by dotted arrows 95. The heat radiator 92 thus carries away heat from prong 20 and receptacle 21 as well when that prong is plugged into the receptacle, as shown by a dotted line 96 in FIG. 1.

According to an embodiment of the invention, the power panel 14 is equipped with the aperture 22 having the detent 24 by equipping such power panel with a heat sink 90 or 91 having that aperture 22 and detent 24, such as shown in FIGS. 6 to 8 for the catch 23 of receptacle 21. In other words, the aperture 22 which is in the panel 14 in the embodiments of FIGS. 1 to 4 is also in the heat sink 90 or 91 in the embodiment of FIGS. 6 ton 8, and the detent catch 24 that is in the panel 14 in the embodiments of FIGS. 1 to 4 is now in the heat sink 90 or 91 in the embodiment of FIGS. 6 to 8.

The receptacle 21 is inserted into the aperture 22 of the power panel 14 and heat sink 90 or 91 from a second side 16 of the power panel until the catch 23 catches the detent 24 of heat sink 90 or 91. This further aids in removing heat from the circuit breaker prong 20 and receptacle 21 through heat sink 90 or 91 and heat radiator 92, thereby enabling the use of the type of receptacle shown at 21 with catch 23 for very high power ratings.

Heat sinks 90 and 91 may be of aluminum, brass or other heat-conductive material and may be molded and retained in the panel 14 with the aid of projections or lugs 97, such as shown in FIG. 6, or may have an external screw thread or other irregular surface 98 aiding in its retention in the molded power panel 14, such as indicated in FIG. 8.

The catch 23 may also be mechanically released from detent 24 of heat sink 90 or 91, and the receptacle 21 thereupon may be removed from such heat sink and power panel 14 for replacement.

By way of example, a receptacle removal tool 145 similar to the above mentioned tool 45 may be employed for that purpose in the manner described above. Catch 23 may be mechanically released from the detent 24 with the tool 145 operating through the front opening 27 of the heat sink as indicated by dotted arrows 146, and the thus released second receptacle 21 may thereupon be removed from the heat sink 90 or 91 through aperture 22 and from power panel 14.

This extensive disclosure will render apparent or suggest to those skilled in the art various modifications and variations within the spirit and scope of the invention.

What is claimed is:

1. In a method of assembling an electric circuit breaker with an electric terminal and a power panel having a first side at said electric circuit breaker and second side at said electric terminal, the improvement comprising in combination:

equipping said electric circuit breaker with a prong;

making a receptacle for said prong;

equipping said receptacle with an external catch for a detent;

equipping said power panel with an aperture having a detent for said catch;

connecting a flexible electric conductor to said receptacle at a safe distance from said power panel and connecting said flexible electric conductor to said electric terminal; and inserting said receptacle into said aperture from said second side of the power panel until said catch catches said detent.

2. A method as in claim 1, including:

assembling said electric circuit breaker with said power panel by insertion of said prong into said receptacle.

3. A method as in claim 1, wherein:

said prong is equipped with resilient contact surfaces for engaging an inside of said receptacle.

4. A method as in claim 1, wherein:

said prong is equipped with a louvered resilient contact structure for engaging an inside of said receptacle.

5. A method as in claim 1, wherein:

said electric circuit breaker has auxiliary prongs for control signal currents; and said power panel is equipped with corresponding auxiliary receptacles for said auxiliary prongs.

6. A method as in claim 1, wherein:

said prong is removed from said receptacle by removal of said electric circuit breaker from said power panel;

said catch is mechanically released from said detent; and said receptacle is removed from said aperture.

7. A method as in claim 1, wherein:

said aperture is provided with a front opening at said first side of the power panel for accommodating said catch at said detent upon complete insertion of said receptacle into said aperture from said second side of the power panel.

8. A method as in claim 7, including:

making a tool insertable into said front opening for mechanically releasing said catch from said detent;

removing said prong from said receptacle by removal of said electric circuit breaker from said power panel;

mechanically releasing said catch from said detent with said tool through said front opening; and removing said receptacle from said aperture.

9. A method as in claim 1, including:

equipping said receptacle with a heat sink.

10. A method as in claim 9, wherein:

said heat sink is provided as an extension of said receptacle.

11. A method as in claim 10, wherein:

said flexible electric conductor is connected to said extension.

12. A method as in claim 9, wherein:

said heat sink is provided in said power panel.

13. A method as in claim 12, wherein:

said heat sink is provided with a heat radiator at said power panel.

14. A method as in claim 12, wherein:

said heat sink surrounds said receptacle in said power panel.

15. A method as in claim 14, wherein:

said heat sink is provided with a heat radiator at said power panel.

16. A method as in claim 12, wherein:

said power panel is equipped with said aperture having said detent by equipping said power panel with a heat sink having said aperture and detent for said catch; and said receptacle is inserted into said aperture of the heat sink from second side of the power panel until said catch catches the detent of said heat sink.

17. A method as in claim 16, wherein:

said heat sink is provided with a heat radiator at said power panel.

18. In a method of assembling an electric circuit breaker with first and second electric terminals and a power panel having a first side at said electric circuit breaker and second side at said second electric terminal, the improvement comprising in combination:

equipping said electric circuit breaker with spaced first and second prongs;

making a first receptacle for said first prong in said first electric terminal;

making a second receptacle for said second prong;

equipping said second receptacle with an external catch for a detent;

equipping said power panel with an aperture having a detent for said catch;

connecting a flexible electric conductor to said second receptacle at a safe distance from said power panel and first electric terminal and connecting said flexible electric conductor to said second electric terminal; and inserting said second receptacle into said aperture from said second side of the power panel until said catch catches said detent.

19. A method as in claim 18, including:

equipping said second receptacle with a heat sink.

20. A method as in claim 18, including:

assembling said electric circuit breaker with said power panel by insertion of said first and second prongs into said first and second receptacles.

21. A method as in claim 18, wherein:

said first and second prongs are equipped with resilient contact surfaces for engaging insides of said first aid second receptacles, respectively.

22. A method as in claim 18, wherein:

said first and second prongs are equipped with first and second louvered resilient contact structures for engaging insides of said first and second receptacles, respectively.

23. A method as in claim 18, wherein:

said electric circuit breaker has auxiliary prongs for control signal currents; and said power panel is equipped with corresponding auxiliary receptacles for said auxiliary prongs.

24. A method as in claim 18, wherein:

said electric circuit breaker has auxiliary prongs for control signal currents between said first and second prongs; and said power panel is equipped with corresponding auxiliary receptacles for said auxiliary prongs between said first and second receptacles.

25. A method as in claim 18, wherein:

said first and second prongs are removed from said first and second receptacles by removal of said electric circuit breaker from said power panel;

said catch is mechanically released from said detent; and said second receptacle is removed from said aperture.

26. A method as in claim 18, wherein:

said aperture is provided with a front opening at said first side of the power panel for accommodating said catch at said detent upon complete insertion of said second receptacle into said aperture from said second side of the power panel.

27. A method as in claim 26, including:

making a tool insertable into said front opening for mechanically releasing said catch from said detent;

removing said first and second prongs from said first and second receptacles by removal of said electric circuit breaker from said power panel;

mechanically releasing said catch from said detent with said tool through said front opening; and removing said second receptacle from said aperture.

* * * * *